United States Patent [19]

Colby

[11] 4,105,244

[45] Aug. 8, 1978

[54] FOLDABLE FURNITURE UNIT

[75] Inventor: Donald Bruce Colby, Los Angeles, Calif.

[73] Assignee: Brown Jordan Company, Philadelphia, Pa.

[21] Appl. No.: 786,888

[22] Filed: Apr. 12, 1977

[51] Int. Cl.[2] ..... A47C 4/28

[52] U.S. Cl. ..... 297/45; 297/441; 5/353.2

[58] Field of Search ..... 297/45, 441; 248/432; 5/353.1, 353.2, 353.3

[56] References Cited

U.S. PATENT DOCUMENTS

| | | | |
|---|---|---|---|
| 1,676,074 | 7/1928 | Brown | 297/45 |
| 1,856,759 | 5/1932 | Grondin | 297/45 |
| 1,882,585 | 10/1932 | Hayes | 297/45 |
| 1,925,246 | 9/1933 | Hayes | 297/45 |
| 2,581,793 | 1/1952 | Hill | 297/45 X |
| 2,582,864 | 1/1952 | Gittings et al. | 297/45 |
| 2,837,142 | 6/1958 | McGuire | 297/45 |
| 2,914,111 | 11/1959 | Mize | 297/45 |
| 3,711,151 | 1/1973 | Upton | 297/45 |

*Primary Examiner*—Roy D. Frazier
*Assistant Examiner*—Peter A. Aschenbrenner
*Attorney, Agent, or Firm*—William J. Foley; Martin L. Faigus

[57] ABSTRACT

A foldable furniture unit employing scissors-acting seat frames and upright side frames has restraining members on the seat rail portions of the seat frames adapted to be positioned adjacent portions of the side frames to reduce relative movement between the seat rails and the side frames and thereby stabilize the unit when it is in unfolded condition for use. The restraining members preferably are provided by cap-like members which are also capable of at least partially closing welt and core receiving slots in the seat rails by which a flexible seat web is secured to the seat rails.

3 Claims, 5 Drawing Figures

FOLDABLE FURNITURE UNIT

BACKGROUND

The foldable furniture units employing this invention are folding chairs, stools and ottomans having scissors-acting seat supporting frames. The consummate predecessor of this class of furniture is the wood and canvas folding camp stool. Anyone who has used a camp stool that has had any substantial prior use has undoubtedly experienced the considerable insecurity associated with using such stools. "Rickety" is the term usually applied to such a unit, because the pivotal connections between the scissors-acting frames invariably loosen with use. And woe the person who gets the camp stool formerly used by a fidgety teenager.

Much design effort has been expended down through the years improving the dependability, useful life and user comfort of the humble scissors-folding camp stool. And much of that effort has been successful. Arm rests and back rests have been added. Side frames also have been added for stability. Improved materials have been substituted; aluminum and plastic for wood, and woven plastic webbing for canvas. And provisions have been made for relatively easy replacement of the flexible web materials for the seat and the back rest. And yet the critical design balance by which a well proportioned chair also possesses stability and the ability to withstand abuse has been difficult to achieve. This becomes apparent with an examination of prior art units.

PRIOR ART

U.S. Pat. No. 2,582,864 granted Jan. 15, 1952 to W. T. Gittings, Louis W. Christianson and William C. Johnson, discloses the now classic addition of arm rest and back rest features to a stool to produce what has come to be known as the "director's chair." The chair disclosed in this patent also embodies a detachable seat arrangement that is pertinent to the invention claimed here.

The following United States Patents disclose differing prior approaches to combining floor resting, side frames with scissors-acting seat frames: U.S. Pat. No. 1,676,074, granted July 3, 1928 to N. N. Brown; U.S. Pat. No. 1,856,759, granted May 3, 1932 to G. T. Grondin; and U.S. Pat. No. 1,882,585, granted October 11, 1932 to T. R. Hayes. The chair units disclosed in these patents utilize the side frames to provide arm rests and to provide support for a back rest. And in each structure lower ends of the scissors-acting seat support frames are pivotally attached to the side frames.

The principal differences between the chair structures of these three patents reside in the manner of attachment of the upper ends of the scissors-acting seat support frames to the side frames. Brown employs a telescoping toggle arrangement which permits substantial transverse movement between the seat supporting frames and the side frames and which has the advantage that the chair can be made to fold to a flat, compact condition without interference between the seat frame and the upper, arm rest portions of the side frames. The disadvantage of the Brown arrangement is that the telescoping toggle connection between the seat frames and the side frames does very little to stabilize the seat against fore and aft movement.

The Grondin and the Hayes chairs, on the other hand, possess different types of sliding connections between the upper ends of the seat frames and the side frames. Although fore and aft stability is imparted for the seat in these chairs, the arrangement seriously limits the chair proportions available to the designer. If the Grondin and Hayes chairs are constructed to fold flat, the arm rest portions of the side frames must be placed at an unnatural height which detracts from the comfort afforded by the chair.

SUMMARY

It is the principal object of this invention to improve the stability and durability of scissors-acting foldable furniture units, such as chairs and ottomans, which have pleasing, comfortable configurations and which are capable of being folded flat when not in use. In accordance with this invention each seat rail portion, i.e., the upper portion of the scissors-acting seat support frame, is provided with at least one and preferably two restraining members which move with the seat rails and independently of the side frames during folding and unfolding of the unit. When the unit is fully unfolded and ready for use, the restraining members are in close proximity to and preferably in engagement with leg portions of the side frames to prevent fore and aft movement of the seat relative the side frames. The rigidity of the side frames is thus imparted to the scissors-acting seat support frame.

In the most preferred embodiment of the invention the restraining members are provided as lateral extensions of cap members which slip over the ends of the seat rails and at least partially cover cavities in the seat rails within which transverse welt edges of the flexible seat are removably secured.

DRAWINGS

DESCRIPTION OF A PREFERRED EMBODIMENT

Figure 2:
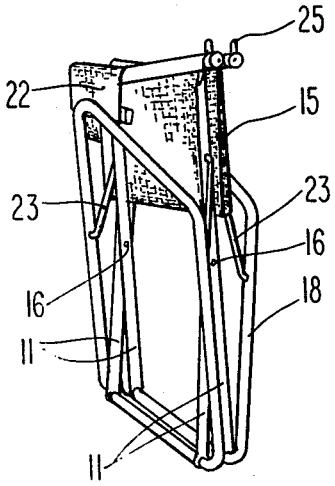
FIG. 2 is a frontal perspective view of the same chair in a folded condition.

The preferred foldable furniture unit illustrated is a chair comprising a pair of scissors-acting seat supporting frames 11 and a cooperating pair of side frames 12. Each scissors-acting seat frame 11 is formed by front and rear pairs of cross legs 13 fixedly attached at their upper ends to seat rails 14 running fore and aft of the unit and carrying a flexible fabric seat 15. The front and rear pairs of cross legs 13 are pivotally connected intermediate their ends at 16 for scissors-like folding and unfolding movement. Each cross leg 13 of the scissors-acting seat frames 11 is pivotally attached at its lower end to one of the side frames 12. In this case the side frames 12 are quadrilateral frames having horizontal base runs 17 to which the cross braces 13 are attached, front and rear upright leg portions 18 and 19, respectively, and upper sloping runs 20 which form arm rests for the chair. A flexible back rest 22 is preferably pivotally attached to the side frames 12 at the upper rear portions thereof where the rear upright leg portions 19 join the arm rest portions 20.

The foldable chair configuration thus far described is conventional. Many chairs of this type were in use prior to this invention. And more or less conventional materials are employed in its construction. For example, the flexible seat 15 and the flexible back rest 22 can be made of woven fabric of natural or synthetic fibers. The seat supporting frames 11 and the side frames 13 are preferably made from metal, such as aluminum, although portions or all of these components could be made of wood or plastic.

Figure 1:
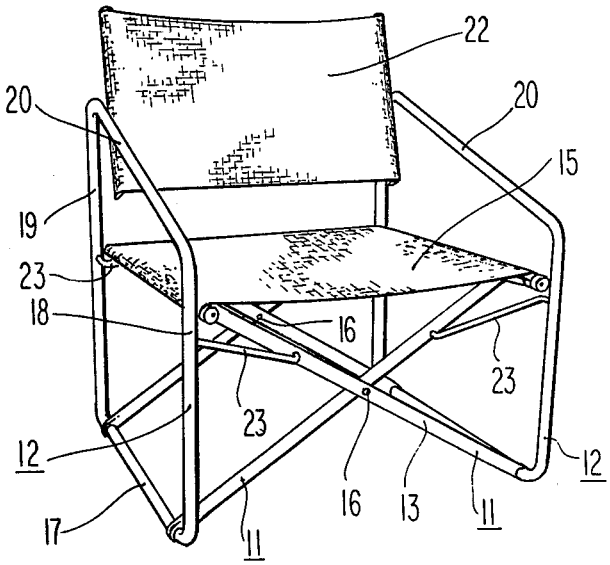
FIG. 1 is a frontal perspective view of a foldable chair embodying this invention.

The folding action of the chair can be understood from a comparison of FIGS. 1 and 2 illustrating, respectively, the unfolded and folded conditions of the structure. Additional stability is imparted to the chair when unfolded for use and control of the relative movement of the parts during folding and unfolding is afforded by four tension, or toggle, links 23 pivotally connected at their ends to an upright leg portion 18 or 19 of the side frames 12 and a nearby cross leg 13 of the seat supporting frame 11. As best shown in FIG. 1, when the chair is unfolded for use the toggle links 23 limit the movement of the side frames 12 outwardly of the seat supporting frames 11 and stop lateral expansion of the entire combined assembly with the ends of the seat rails 14 at rest against the inner surfaces of side frame leg portions 18 and 19. When the weight of a person is applied to the seat 15, that weight tends to force the seat rails downwardly and spread the scissors acting cross legs 13. These forces are opposed by the tension links 23 which, in effect, draw the side frame legs 18 and 19 inwardly and more snuggly up against the ends of the seat rails 14, further locking the chair structure against expansion.

The chair is folded by grasping the seat rails 14 and pulling them upwardly from the position illustrated in FIG. 1 and toward the position illustrated in FIG. 2. As the cross legs 13 move together in scissors fashion the lower rungs 17 of the side frames are drawn together by virtue of being connected to the lower ends of the cross legs and toggle links 23 draw the upper portions of the side frames 12 toward each other until the components are brought to the substantially flat condition illustrated in FIG. 2.

When the chair is fully unfolded for use as shown in FIG. 1, there is presented an arrangement of components which is particularly resistent to sideways and up and down forces applied to the seat. In other words, transversly and vertically the chair is a rigid, rugged structure. However, the conventional structure thusfar described is not particularly resistent to horizontal forces tending to move the seat 15 forwardly or rearwardly of the chair. The chair structure, therefore, is not particularly resistent to the forces applied by the occupant who leans back and tilts the chair rearwardly. All of the pivotal connections in the folding system, i.e., the pivotal connections between the lower ends of the cross legs 13 and the side frame base runs 17, the pivotal connections 16 between the cross legs, and the pivotal connections between the toggle lengths 23 and the leg portions 18 and 19 and the cross legs 13 are subjected to torsional forces which tend to loosen those pivotal connections. This has been a major deficiency of folding chairs of this type. Design considerations, primarily the desire for a low comfortable arm rest 20 have dictated that there should be no sliding connections between the ends of the seat rails 14 and the front and rear leg portions 18 and 19. With only a double pivoted toggle link 23 connection between the leg portions 18 and 19 and their respective nearby cross legs 13, this region of the structure constitutes a weak link, so to speak, in the structural integrity of the unit. With repeated use these chairs develop loose pivotal joints and become "rickety" in the sense of the old time camp stool. Such conditions simply cannot be tolerated in quality furniture.

The present invention solves this problem. And the critical element of the invention is a restraining member 25 preferably carried at each end of each of the two seat rails 14. These restraining members are preferably formed as unitary extensions or protrusions from cap-like members, or caps, 26 which slip over the ends of the seat rails 14.

Figure 3:
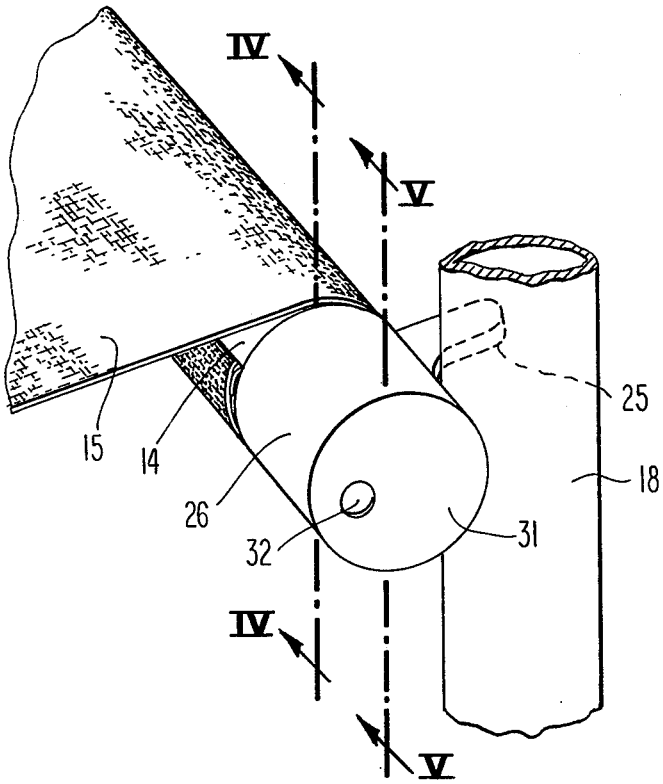
FIG. 3 is a fragmentary perspective view of a seat rail region of the chair illustrated in FIG. 1.

As can best be seen in FIG. 3, the restraining members 25 are carried by the seat rails 14 in such a manner as to come closely adjacent to an upright leg 18 or 19 of the chair side frame 12 when the chair is in its unfolded condition for use. The restraining members 25 on the front ends of seat rails 14 move in behind the front leg portions 18, and the restraining members 25 at the rear ends of the seat rails 14 move in ahead of the upright rear portions 19 in position to limit fore and aft movement of the seat rails with respect to the leg portions 18 and 19. The chair could be provided with but one pair of restraining members at the rear ends of the seat rails 14 to restrain movement of the seat normally caused by a person leaning back in the chair and thus greatly reduce the strain on the pivotal connections within the chair structure and enhance the life of the chair. However, even greater benefit and a more rigid structure can be achieved if, as shown in the drawings, both ends of each seat rail are equiped with the restraining members 25.

Figure 4:
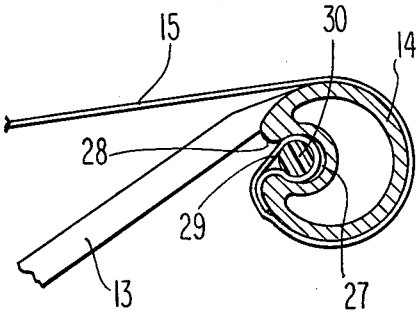
FIG. 4 is a sectional view of the seat rail taken as indicated by the line IV—IV in FIG. 3.
Figure 5:
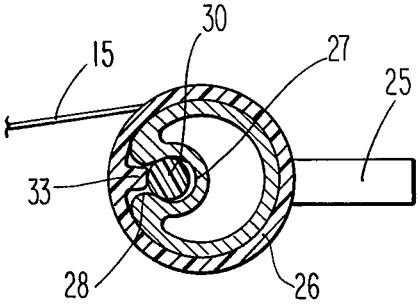
FIG. 5 is another sectional view of the seat rail taken as indicated by the line V—V in FIG. 3.

The cap members 26 which carry restraining members 25 are unique in several respects and the features thereof are illustrated in FIGS. 3, 4 and 5. Referring particularly to FIG. 4, each seat rail 14 is preferably made from an aluminum extrusion possessing a welt receiving cavity 27 and a longitudinal slot 28 of reduced width providing access to the cavity 2. The flexible seat for this chair is removably affixed to the seat rails 14 by having an edge welt 29 at opposite edges thereof disposed within a seat rail cavity 27 and held therein by a rod like core 30 which expands the welt 29 to a diameter greater than the width of the access slot 28. Detachment of seat 15 is accomplished by merely sliding the cores 30 out the ends of the welts 29 and the seat rails 14, allowing the seat welts 29 to be withdrawn through the access slots 28. A new seat can be attached by reversing this procedure.

Cap members 26 are adapted to at least partially close the ends of the cavity 27 and the seat rails 14. If a perfectly clean design is desired, the face 31 of each cap member 26 can be solid, although it is preferred that an opening 32 be provided therein of a diameter just slightly larger than the diameter of the removable core 30 to permit the core to be removed from the seat rail while the cap member 26 is in place.

To prevent the cap members 26 from rotating on the seat rails thereby misplacing the restraining members 25 provided thereon, each cap member is preferably provided with an inwardly projecting key portion 33 sized to slip snuggly into the access slot 28 in the seat rail 14 (see FIG. 5). Cap members 26 are preferably molded of plastic material, although they can be die cast from metal.

What is claimed is:

1. In a foldable furniture unit, a pair of upright side frames each having at least one leg portion, a pair of inclined cross frames pivotally connected intermediate their ends, each cross frame having its lower region pivotally connected to a lower region of a side frame, each cross frame including at its upper end a seat rail extending front to rear of the unit, a flexible seat having its side edges secured to the seat rails of said cross frames, the arrangement being such that when the unit is unfolded for use said seat rails are respectively in close proximity to said leg portions of said side frames and when the unit is folded for storage said seat rails are disposed above the uppermost regions of said leg portions of said side frames, said seat rails having therein longitudinal cavities reduced width access slots thereto, said seat at its side edges being provided with welts disposed in said rail cavities, a removable core disposed in each welt for preventing withdrawal of the welts through said slots, and at least one cap member on an end of each seat rail, said cap members constituting at least a partial closure for ends of said rail cavities, and at least one cap member on each seat rail having a restraining member projecting therefrom and extending closely adjacent a side frame leg portion when the unit is unfolded, said restraining members limiting fore and aft movement of said seat rails relative said side frames.

2. The furniture unit of claim 1 further characterized in that each cap member has a key portion projecting into the access slot of its seat rail for preventing rotation of the restraining members with respect to the rails.

3. The furniture unit of claim 1 in which each side frame has two leg portions, there is a cap member with a restraining member thereon on each end of each seat rail, and the restraining members on each seat rail extend between the leg portions of the adjacent side frame to limit fore and aft movement of the seat rails relative the side frames.

* * * * *